United States Patent [19]

Bryer et al.

[11] 4,363,168

[45] Dec. 14, 1982

[54] METHOD OF FORMING AN ELECTRICAL CONNECTION UNDERWATER

[75] Inventors: James E. Bryer, Millom; Alan P. Mayes; Keith Allen, both of Barrow-in-Furness, all of England

[73] Assignee: VO Offshore Ltd., Barrow-in-Furness, England

[21] Appl. No.: 157,538

[22] Filed: Jun. 9, 1980

[30] Foreign Application Priority Data

Jun. 16, 1979 [GB] United Kingdom ..... 7921020

[51] Int. Cl.[3] ..... H01R 43/00

[52] U.S. Cl. ..... 29/869; 166/65 R; 166/341; 174/21 R; 339/117 R

[58] Field of Search ..... 166/65 R, 341; 252/194; 34/9; 174/21 R; 339/117 R; 29/868, 869, 870

[56] References Cited

U.S. PATENT DOCUMENTS

| | | | |
|---|---|---|---|
| 3,638,732 | 2/1972 | Huntsinger et al. | 166/65 R X |
| 3,643,207 | 2/1972 | Cairns | 339/117 R X |
| 3,772,636 | 11/1973 | Webb | 339/117 R |
| 3,903,012 | 9/1975 | Brandreth | 252/194 |
| 3,972,581 | 8/1976 | Oldham | 339/117 R X |
| 3,980,369 | 9/1976 | Panek | 339/117 R X |
| 4,050,765 | 9/1977 | Duesterhoeft et al. | 339/117 R |
| 4,147,511 | 4/1979 | Bartlett | 34/9 X |
| 4,161,450 | 7/1979 | Vitat et al. | 34/9 X |
| 4,192,569 | 3/1980 | Mucci | 174/21 R X |

FOREIGN PATENT DOCUMENTS

| | | |
|---|---|---|
| 1379525 | 1/1975 | United Kingdom . |
| 1562685 | 3/1980 | United Kingdom . |

*Primary Examiner*—Carl E. Hall
*Assistant Examiner*—Carl J. Arbes
*Attorney, Agent, or Firm*—Armstrong, Nikaido, Marmelstein & Kubovcik

[57] ABSTRACT

An electrical connector suitable for use in connecting together electrical cables underwater comprises a first portion secured to a first cable and a second portion secured to a second cable. The first and second portions include a first electrical contact and a second electrical contact respectively. The first and second portions engage together so that the first and second contacts are in electrical contact with one another and so that a closed free space is formed between the two portions. A means is provided to enable flushing and drying fluids and electrically insulating fluid to be introduced into the free space. The electrical connector is particularly useful for connecting a down hole electric pump in a subsea oil well to a source of electricity.

8 Claims, 4 Drawing Figures

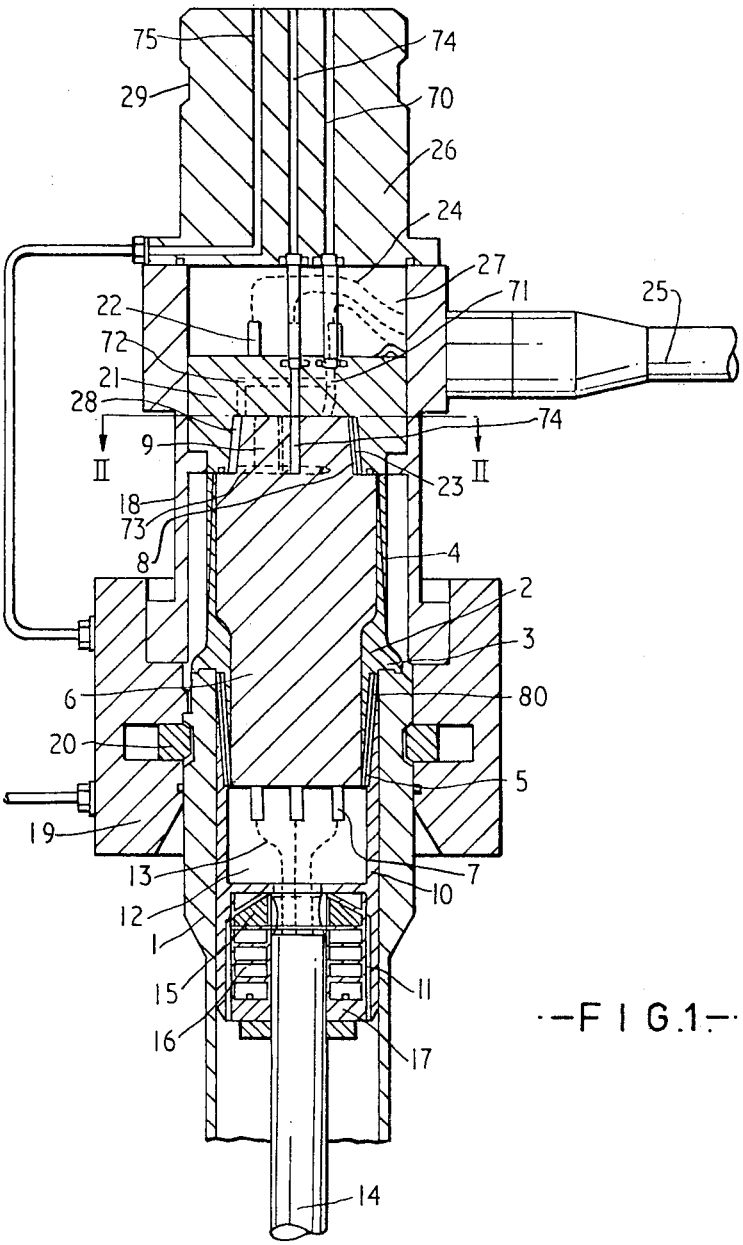
-FIG.1-

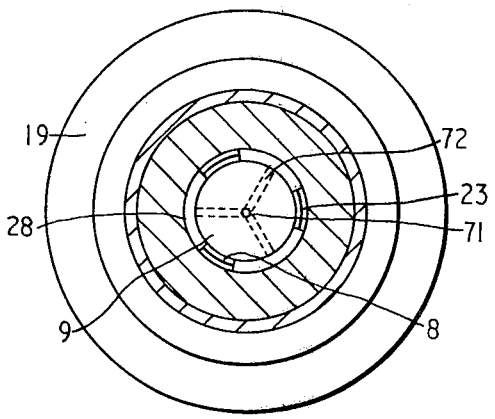
—FIG.2—

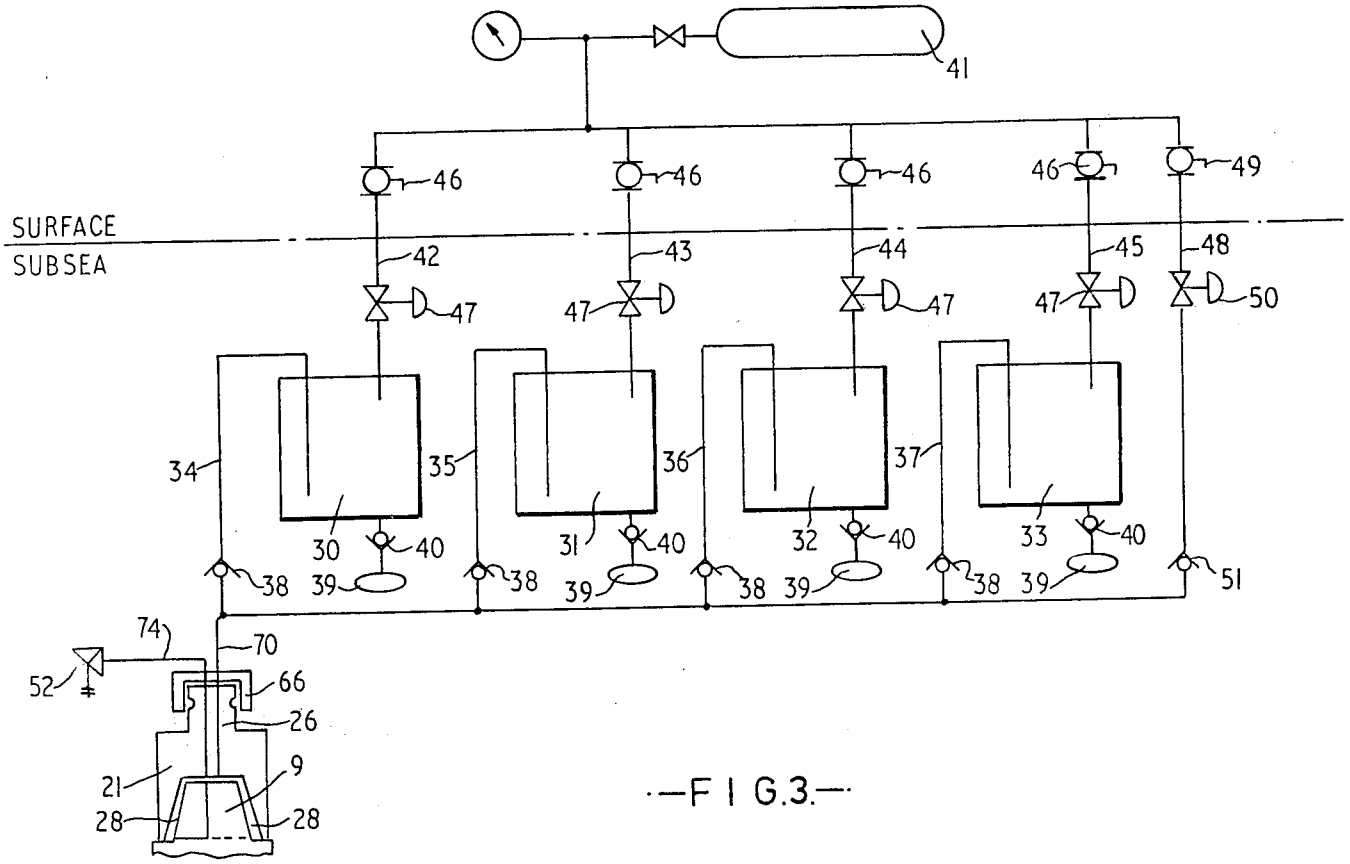
—FIG.3.—

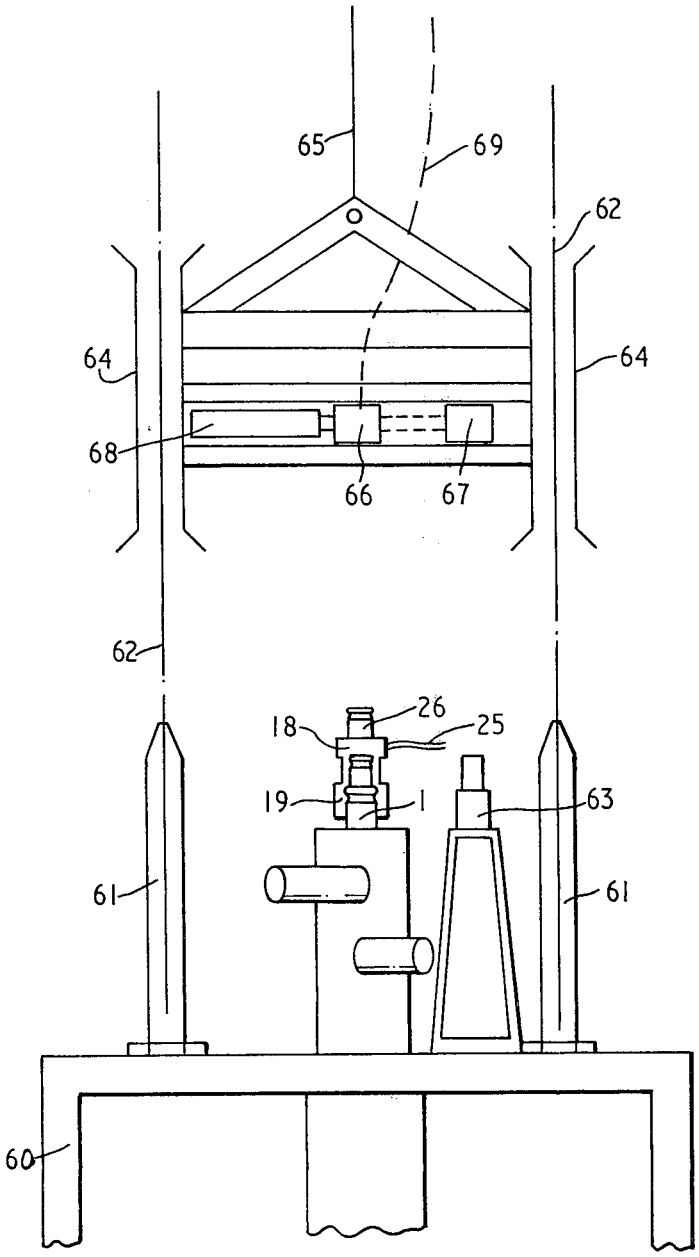
-FIG.4-

METHOD OF FORMING AN ELECTRICAL CONNECTION UNDERWATER

This invention relates to electrical connectors and more particularly, but not exclusively, is concerned with electrical connectors suitable for use in connecting together electrical cables underwater.

According to one aspect of the present invention there is provided an electrical connector comprising:

a first portion including a first electrical contact, a second portion including a second electrical contact the two portions being engageable together such that the first and second contacts are in electrical contact with one another and such that a closed free space is formed between the two portions, and a means to enable fluids to be introduced into and removed from said free space.

According to another aspect of the present invention there is provided a method of forming an electrical connection underwater between first and second cables, which method comprises:

providing a first connector portion including a first electrical contact connected to the first of the cables, providing a second connector portion including a second electrical contact connected to the second of the cables, engaging together the first and second connector portions so as to electrically connect the first and second contacts, flushing out and drying the free space between the connector portions, and introducing electrically insulating liquid into said free space.

The free space can be flushed out and dried by introducing appropriate liquids and gases into the same. For example, a gas such as nitrogen may be introduced so as to expel the contaminating water, followed by demineralised water or the like to remove residual contamination, a water absorbing liquid such as an isopropanol/-Freon 113 mixture to remove residual demineralised water or the like and a further liquid such as Freon 113 or 12 to absorb the water absorbing liquid. Each of the liquids in turn may be expelled from the space by a gas, such as nitrogen gas, before the introduction of the next liquid. Also, before the introduction of the dielectric liquid, gas, such as nitrogen gas, is passed through the space in order to completely evaporate any residual liquid and dry the space. The dielectric liquid may be, for example, transformer oil.

The present invention is particularly useful for joining cables supplying electric power to down-hole pumps in sub-sea oil wells. When extracting oil from the seabed, it is usual to erect a production platform to serve a plurality of wells in the vicinity. An electric pump is installed in each well at a depth which may be up to 10,000 feet or even more and electricity for the pump is supplied from the platform. Advantageously, this power is supplied by a first cable extending from the platform to the Christmas tree at the well head and a second cable extending from the Christmas tree down the well to the pump, the two cables being joined together at the Christmas tree by means of a connector. Some time can elapse between laying the cable from the platform on the one hand and introducing the pump and the down-hole cable on the other and installation is facilitated by using two cables in this way rather than a single cable extending from the platform to the pump. Further, having a cable connection at the Christmas tree also enables the pump to be more readily withdrawn for maintenance purposes. It will be appreciated that such an arrangement would be greatly simplified by making the connection between the cables by means of a connector comprising mateable connector portions so that the cables can be connected and disconnected relatively easily when desired. However, if such a connector is used, the portions of the connector will be exposed to seawater for some period of time prior to and whilst being mated together and the presence of such seawater may impair the efficiency of the connector particularly in the case where the voltage is very high and very high insulation resistances are needed. Such problems can be avoided by using, as the connector, a connector in accordance with the present invention.

For a better understanding of the invention and to show how the same may be carried into effect, reference will now be made, by way of example, to the accompanying drawings in which:

FIG. 1 is a section through an electrical connector of the present invention for supplying electrical power to a pump in a subsea oil well, FIG. 2 is a section along line II—II of FIG. 1, FIG. 3 is a schematic diagram of the connector of FIG. 1 and its associated flushing and drying equipment, and FIG. 4 is a view of the electrical connector of FIG. 1 in position at the top of a Christmas tree.

Referring to FIG. 1 there is shown the tubing head 1 at the upper end of the oil well producing tubing. Mounted on the tubing head 1 is a connector in accordance with the present invention. The connector includes a male first connector portion and a female second connector portion arranged to be engaged together to make the desired connection.

The male connector portion comprises first and second parts threaded together. The first part of the male connector portion is in the form of a first tubular member 2 formed of steel and provided with an external shoulder 3. A first external thread 4 is provided at a first end of the member 2 and a second external thread 5 is provided at the second end. Provided within the member 2 is a body 6 formed of cast electrically insulating material in which are embedded three electrical conductors (not shown). Each conductor connects one of three terminals 7 provided in the body at the second end of the member 2 with one of three electrical contacts 8 located equidistantly about the periphery of, and protruding from, a frustoconical part 9 of the body at the first end of the member 2. The second part of the male connector portion is in the form of a second tubular member 10 having a first internal thread at its first end and a second internal thread 11 at its second end. The first and second parts of the male connector portion are secured together so as to define a first terminal chamber 12 by co-operation of the second external thread 5 of the first part and the first internal thread of the second part. The three terminals 7 are connected to the three conducting cores 13 (one for each phase) of the cable 14 for carrying electrical current to the pump (not shown) located at the bottom of the well. The cable 14 is held in the second part of the male connector portion by a wedge clamp 15 which grips the armour of the cable and the outer sheath of the cable is sealed by compression rings 16, the clamp 15 and rings 16 being secured in place by an externally threaded gland ring 17 which co-operates with the internal thread 11. After assembly of the male connector portion, the terminal chamber 12 may be filled with oil or other suitable compound through suitable conduits (not shown). The first external thread 4 on the first part of the male connector portion corresponds to a standard drill string thread so as to allow the male connector portion and the cable 14 secured thereto to be lowered into position whilst suspended from the drill string.

The female connector portion comprises a tubular member in the form of a spool piece 18 secured at one end to a hydraulic clamp 19 having a plurality of wedge-shaped dogs 20 engageable with an external peripheral groove provided on the tubing head 1. Provided within the spool piece 18 is a body 21 formed of cast electrically insulating material in which are embedded three electrical conductors (not shown). Each conductor connects one of three terminals 22 provided at one end of the body with one of three electrical contacts 23 located equidistantly around the periphery of, and protruding from, frustoconical recess provided at the other end of the body. The shape and dimensions of the frustoconical recess correspond to the shape and dimensions of the frustoconical part 9 of the male connector portion such that when the male and female portions are engaged together, the contacts 8 and 23 are in electrical contact and free spaces 28 are provided between the bodies 6 and 21 (see FIG. 2). The three terminals 22 are connected to the three conducting cores 24 (one for each phase) of the cable 25 for carrying electrical current from a platform. A lifting hub 26 is fitted to the other end of the spool piece 18 so as to define a terminal chamber 27. The chamber 27 may be filled with oil or other suitable compound via suitable conduits (not shown) after assembly. The lifting hub 26 carries an external groove 29 whereby it may be gripped by a suitable latching device. A first axial conduit 70 extends through the hub 26, chamber 27 and communicates with the free spaces 28 via axial and radial conduits 71 and 72 provided in body 21. These conduits allow fluids to be introduced into the free spaces 28. Similar radial and axial conduits 73 and 74 allow egress of fluids from the free spaces 28. Hydraulic lines (one of which is denoted by reference numeral 75) also pass through the hub 26 to supply the latching dogs 20 with hydraulic power.

Referring now to FIG. 3, the electrical connector is shown connected to its associated flushing and drying equipment. This is in the form of four liquid containers denoted by reference numerals 30, 32, 32 and 33 which are operably connected to conduit 70 by pipes 34, 35, 36 and 37 respectively. Each of these pipes includes a one way valve 38 and each container has an associated pressure compensating bag 39 connected to it via a one way valve 40. Each of the containers 30, 31, 32 and 33 is connected to a container 41 by means of pipes 42, 43, 44 and 45 respectively, each including a ball valve 46 and a pressure regulator 47. Further, the container 41 may be directly connected to the conduit 70 by means of pipe 48 including a ball valve 49, a pressure regulator 50 and a one way valve 51. The outlet conduit 74 of the connector is open to the sea via a back pressure valve 52. Container 30 is for demineralised water, container 31 is for a mixture of isopropanol and Freon 113, container 32 is for Freon 113 or Freon 12, container 33 is for a dielectric liquid such as transformer oil and container 41 is for nitrogen gas under pressure. Freon 113 is trichlorotrifluoroethane and Freon 12 is dichlorodifluoromethane. The containers 30, 31, 32 and 33 may be mounted on a common framework located under the sea adjacent to the electrical connector with the nitrogen container 41 located at the surface as shown. Alternatively, however, all the containers may be located at the surface.

Referring to FIG. 4, there is shown the connector mounted on the Christmas tree. The Christmas tree is surrounded by a framework 60 carrying four guide posts 61 from which wires 62 extend upwards to the surface. Also mounted on the framework 60 is a dummy stub 62. This is a member having an outer configuration essentially similar to the external configuration of the tubing head 1 and of the male connector portion. This dummy stub 63 is offset from the central position of the Christmas tree. There is also shown a lowering frame including four tubular members 64 through which the wires 62 pass and which are spaced apart by a distance equal to that separating the posts 61. The lowering frame is secured to a lowering cable 65 and carries a latching device 66 capable of engagement with the groove 29 of the lifting hub 26 of the connector. The latching device 66 is moveable from the central position as shown to an offset position denoted by reference numeral 67 by means of a hydraulically operated transfer mechanism 68. An umbilical 69 includes a pipe (not shown) connected to the pipes 34, 35, 36, 37 and 48 of the flushing and drying equipment and also the hydraulic lines for supplying hydraulic power to the latching dogs 20 and to the hydraulic transfer mechanism 68.

In use, the cable 25 connecting the female connector portion with the production platform (not shown) will ordinarily be laid first along the seabed whilst the end carrying the female connector portion will be held at the surface. Subsequently, the female connector portion is held in the latching device 66 of the lowering frame and is then lowered down to the well head by means of the lowering cable 65, the lowering frame being guided by the guide wires 62 and by the posts 61 entering into the locating tubes 64. At this stage, the pump will not have been installed in the well and hence it will not at this time be possible to engage the female connector portion with the male connector portion. Therefore the transfer mechanism 68 is actuated so as to transfer the female connector portion to its offset position whereby continued lowering of the lowering frame will cause the male connector portion to be seated on the dummy stub 63 to which it is secured by the dogs 20 pending installation of the well pump. The lowering frame can then be raised to the surface. In due course, the pump and its associated cable 14 terminating in the male connector portion will be lowered into the well hole by the drill string as aforedescribed until the shoulder 3 abuts against the rim of the tubing head 1 via the intermediary of a sealing ring 80. The connection of the cable 14 to the cable 25 can then be made by lowering the lowering frame again, engaging the latching device 66 with the female connector portion located on the dummy stub 63, releasing the dogs 20 lifting the frame to raise the female connector portion off the stub 63, moving the female connector portion across from its offset position to its central position via the transfer mechanism 68 and lowering the female connector portion onto the male connector portion. Actuation of the latching dogs 20 then causes the female connector portion to be pulled down onto the male connector portion so that the sealing ring 80 is compressed between sealing surfaces on the shoulder 3 and on the rim of the tubing head 1 and so that the contacts 8 and 23 abut against each other (see FIG. 2).

The free spaces 28 within the connector will contain seawater and, in accordance with the invention, this is removed and the free spaces 28 are then dried and filled with a dielectric fluid. This is effected by closing ball valves 46 and opening valve 49 thereby allowing nitrogen to enter into the free spaces 28 from the container 41 and expel the bulk of the seawater out of spaces 28 via the back pressure valve 52. Then, by closing all the ball valves except for that in pipe 42 demineralised water is caused to flow into the spaces 28 under the influence of the nitrogen pressure in container 41. The regulating valve 47 maintains a constant pressure above the liquid in the container. This removes any residual seawater film from the spaces 28. Then nitrogen is introduced as before so as to expel the demineralised water via valve 52. Thereafter, the isopropanol/Freon 113 mixture from container 31 is introduced into the spaces 28 by closing all the ball valves 46 except for that in pipe 43. This mixture absorbs any remaining demineralised water and also removes any grease which may be present in the connector. It is then flushed out of the free spaces 28 by nitrogen gas by appropriately actuating the ball valves as before. Freon 113 or 12, depending on the depth of operation, from container 32 is then introduced into the free spaces 28 by closing all the ball valves 46 except for that in pipe 44. This is for the purpose of absorbing the remaining isopropanol/Freon mixture and it is subsequently expelled from the free space 28 by nitrogen from container 41 by suitably actuating the ball valves as before. The nitrogen is allowed to flow until the Freon has been completely evaporated and the annular space is dry. Finally, the dielectric fluid is introduced into the free spaces 28 by closing all the ball valves 46 except for that in pipe 45. The fluid is allowed to flow through the spaces 28 until they are completely full and the fluid has started to discharge from valve 52. The umbilical 69 is then disconnected and removed together with the flushing and drying equipment. Self sealing valves in the connector automatically prevent seawater coming into contact with the dielectric fluid. Finally a protective cap is placed on the connector.

Although the connector as above described is a high voltage well head connector, it will be appreciated that the principle of the present invention may be applied to any other mateable connector for use in an underwater environment (whether the voltage is high or low) where high reliability is required. Thus the present invention is also of use when, for example, making connections to electrohydraulic or multiplexed control systems on wet well heads.

What we claim is:

1. A method of forming an electrical connection underwater between first and second cables, which method comprises:

(a) providing a first connector portion including a first electrical contact connected to the first of the cables;

(b) providing a second connector portion including a second electrical contact connected to the second of the cables;

(c) engaging together the first and second connector portions under water so as to electrically connect the first and second contacts and form a closed free space between the connector portions within which space the first and second contacts are disposed;

(d) flushing out the free space between the connector portions;

(e) drying the free space; and (f) introducing electrically insulating liquid into said free space.

2. A method in accordance with claim 1 wherein the step of flushing out the free space is effected by:

(a) introducing a gas into the free space to expel any water which may be present;

(b) flushing out the free space with demineralised water; and (c) flushing out the free space with a water absorbing liquid.

3. A method in accordance with claim 2 wherein the water absorbing liquid is a mixture of isopropanol and trichlorotrifluoro ethane.

4. A method in accordance with claim 2 and including the additional step of flushing out the water absorbing liquid with trichlorotrifluoro ethane or dichlorodifluoro methane.

5. A method in accordance with claim 1 wherein the step of drying the free space is effected by passing a gas through the free space after flushing.

6. A method in accordance with claim 5 wherein the gas used to dry the free space is nitrogen.

7. A method of electrically connecting an electric pump in a subsea oil well having a wellhead to an electrical supply which comprises the steps of:

(a) providing an electrical connector comprising:

(i) a first portion including a first electrical contact, (ii) a second portion including a second electrical contact, the two portions being engageable together such that the first and second contacts are in electrical contact with one another and such that a closed free space is formed between the two portions, and (iii) a means of enabling fluids to be introduced into and removed from said free space, (b) securing one of the connector portions to an end of a cable such that the electrical contact of the connector is electrically connected to the cable, (c) laying the cable on the seabed so that it extends from a supply of electricity to the wellhead, (d) securing the other of the connector portions to an end of another cable in a manner such that the electrical contact of said other connector portion is electrically connected to said other cable and electrically connecting the electric pump to the other end of said other cable, (e) lowering said other cable to the wellhead so that the pump enters the oilwell, (f) engaging together the first and second connector portions so that the electrical contacts of said portions are in electrical contact and the closed free space is formed, (g) flushing out and drying the free space between the connector portions, and (h) introducing electrically insulating liquid into the free space.

8. A method in accordance with claim 7 wherein, prior to the lowering of said other cable, the connector portion secured to the first-mentioned cable is stored in a temporary location at the wellhead, and wherein said other cable is lowered to the wellhead by means of a lowering frame which is guided down to the wellhead, the lowering frame carrying a latching device capable of gripping the temporarily stored connector portion and transferring it into engagement with the connector portion secured to said other cable.

* * * * *